US005505327A

United States Patent [19]

Witt

[11] Patent Number: 5,505,327

[45] Date of Patent: *Apr. 9, 1996

[54] FLEXIBLE LINED TANK WITH VACUUM IN THE MANWAY

[76] Inventor: F. C. Witt, P.O. Box 488, Claremore, Okla. 74018

[ * ] Notice: The term of this patent shall not extend beyond the expiration date of Pat. No. 5,397,020.

[21] Appl. No.: 403,221

[22] Filed: Mar. 13, 1995

Related U.S. Application Data

[63] Continuation-in-part of Ser. No. 182,576, Jan. 18, 1994, Pat. No. 5,397,020.

[51] Int. Cl.[6] ..... B65D 90/04

[52] U.S. Cl. ..... 220/404; 220/465

[58] Field of Search ..... 220/465, 403, 220/404, 461, 420, 469, 565

[56] References Cited

U.S. PATENT DOCUMENTS

| | | | |
|---|---|---|---|
| 2,338,604 | 1/1944 | Silveyra | 229/14 |
| 2,346,423 | 4/1944 | Gray | 73/51 |
| 2,762,736 | 9/1956 | Beuglet | 154/82 |
| 2,794,570 | 6/1957 | Downs | 220/63 |
| 3,167,209 | 1/1965 | Jones | 220/63 |
| 3,450,254 | 6/1969 | Miles . | |
| 3,484,011 | 12/1969 | Greenhalgh et al. | 215/12 |
| 3,848,765 | 11/1974 | Durkop . | |
| 4,187,956 | 2/1980 | Schrawer | 220/465 |
| 4,230,061 | 10/1980 | Roberts et al. | 114/74 |
| 4,408,628 | 10/1983 | Monk . | |
| 4,437,987 | 3/1984 | Thornton et al. | 210/137 |
| 4,524,609 | 6/1985 | Sharp | 73/49.2 |
| 4,537,328 | 8/1985 | Keesee et al. | 220/445 |
| 4,796,676 | 1/1989 | Hendershot et al. . | |
| 4,920,786 | 5/1990 | Danielson . | |
| 5,056,680 | 10/1991 | Sharp | 220/465 |
| 5,072,623 | 12/1991 | Hendershot | 73/49.2 |
| 5,253,778 | 10/1993 | Sirosh | 220/590 |
| 5,259,895 | 11/1993 | Sharp . | |
| 5,397,020 | 3/1995 | Witt | 220/404 |

FOREIGN PATENT DOCUMENTS

| | | |
|---|---|---|
| 633127 | 2/1961 | Canada . |
| 2225456 | 12/1973 | Germany . |

*Primary Examiner*—Stephen J. Castellano
*Attorney, Agent, or Firm*—Head & Johnson

[57] ABSTRACT

A vinyl lined tank has a manway opening formed of a vertical portion and a horizontal flange, with a vertical pathway, open at the bottom, inside the vertical portion that communicates with a conduit in the flange or in the vertical portion so that a vacuum can be maintained within the pathway that prevents the collapse of the liner when the tank is empty.

5 Claims, 6 Drawing Sheets

FLEXIBLE LINED TANK WITH VACUUM IN THE MANWAY

RELATED PATENTS

This application is a continuation-in-part of application Ser. No. 08/182,576, filed Jan. 18, 1994, now U.S. Pat. No. 5,397,020 dated Mar. 14, 1995.

BACKGROUND OF THE INVENTION

This invention relates to the method by which a vacuum may be maintained between the interior of a storage tank and an interior flexible liner to prevent the collapse of the interior flexible liner as the fuel is removed from the storage tank.

The containment of liquids, slurries and other non-solid substances is currently provided by storage tanks. These storage tanks have been built of steel or similar metals in order to provide strength, but have also been built of durable plastics. Many of the storage tanks, particularly those for storing fuels, such as gasoline, heating oil and such, have been installed underground. Other storage tanks have been installed above ground or partially below the surface. Storage tanks are also used for the transport of fluids such as on railroad tank cars, trucks, watercraft and other transportation vehicles.

For a variety of reasons, it has been advantageous to install flexible liners internally within the storage tanks. These flexible liners provide a safety feature, preventing the escape of the stored fluid from the storage tank in the event that stresses, damage or corrosion cause a leak in the storage tank. Where the fuel contained is toxic or otherwise potentially harmful to the environment about the storage tank, the addition of an internal flexible liner has been an effective means of prevention of potential contamination. The presence of an internal flexible liner also serves to prevent the contamination of the stored fluid from external sources, such as ground water in underground tanks which might develop a crack or hole over time, or rainwater and other contaminants which might seep into above ground tanks if similarly damaged.

Many existing storage tanks, particularly underground fuel storage tanks, have been retrofitted with internal flexible liners to prevent ground contamination by potential leaks of the fuel. The flexible liner, whether installed in underground fuel storage tanks or other storage tanks, is typically maintained in place while the storage tank is empty, or only partially full, by means of negative pressure between the external wall of the flexible liner and the internal wall _surface of the storage tank. Proper maintenance of the negative pressure or vacuum is not easy.

Therefore, it is a principal object of the invention to provide an improved method for establishing and maintaining the negative pressure or vacuum between the inner wall surface of the solid storage tank and the outer wall surface of the flexible liner, both during installation or replacement of the flexible liner and while the flexible liner is installed.

SUMMARY OF THE INVENTION

The method of maintaining a negative pressure or vacuum between the inside wall of the storage tank and the outside wall of the flexible liner is described. In storage tanks with existing flexible liners or in storage tanks where a flexible liner is to be installed, a separate vacuum collar is positioned within the manway or large vertical opening for the storage tank.

The installation of flexible liners in new or existing underground tanks is done through a large opening, a manway, which is also used to provide access for the pipes and vents used to fill the tank and to withdraw fluids from the tank.

In the embodiment, the manway opening is equipped with a horizontal flange on which a gasket is placed. As described in U.S. Pat. No. 5,397,020, a separate vacuum collar is then inserted into the manway opening so it rests on the gasket which rests on the flange. Another gasket is placed on top of the vacuum collar and the flexible lining pulled over the second gasket. A third gasket is placed over the flexible lining and a steel ring placed over the gasket. The steel ring, gaskets, flexible lining and vacuum collar are all tightened by bolts to maintain a negative pressure or vacuum seal in an annular zone between the vacuum collar and the manway.

As disclosed herein, the manway is specially designed with one or a plurality of tubular pathways whereby air from the space between the inner wall of the storage tank and the outer wall of the flexible liner may be drawn out via communicative conduits in the manway. At the exhaust end, the vacuum conduit is equipped with a gauge to indicate the presence of negative pressure or vacuum, and with connectors to connect it to a vacuum pump. The tubular pathways extend within the manway with an opening, usually at the bottom, a sufficient distance to maintain the necessary vacuum to hold the flexible liner in place. The pathways maintain a tubular space in the liner in the manway.

DETAILED DESCRIPTION OF THE PREFERRED EMBODIMENT

Figure 1:
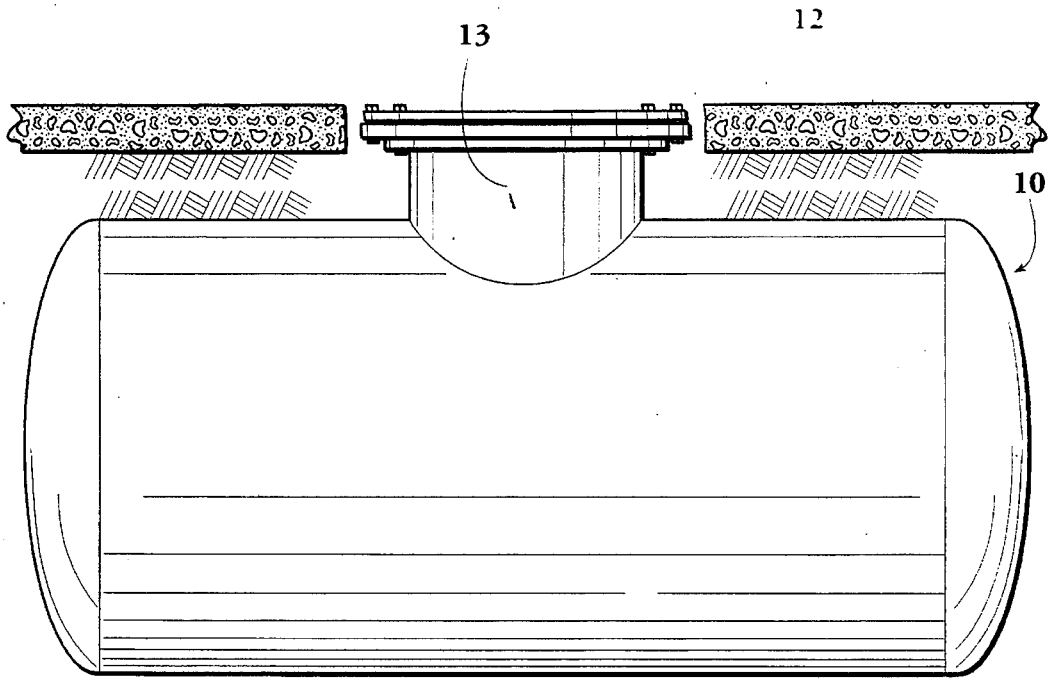
FIG. 1 shows a view of typical storage tank installed underground.

Referring to the drawings, the numeral 10 refers to an underground storage tank which has been positioned beneath ground level 12. A large access opening or manway 13 is shown through which the flexible liner is installed. Although an underground tank is shown, the concepts of this invention are applicable to above ground lined vessels.

Figure 2:
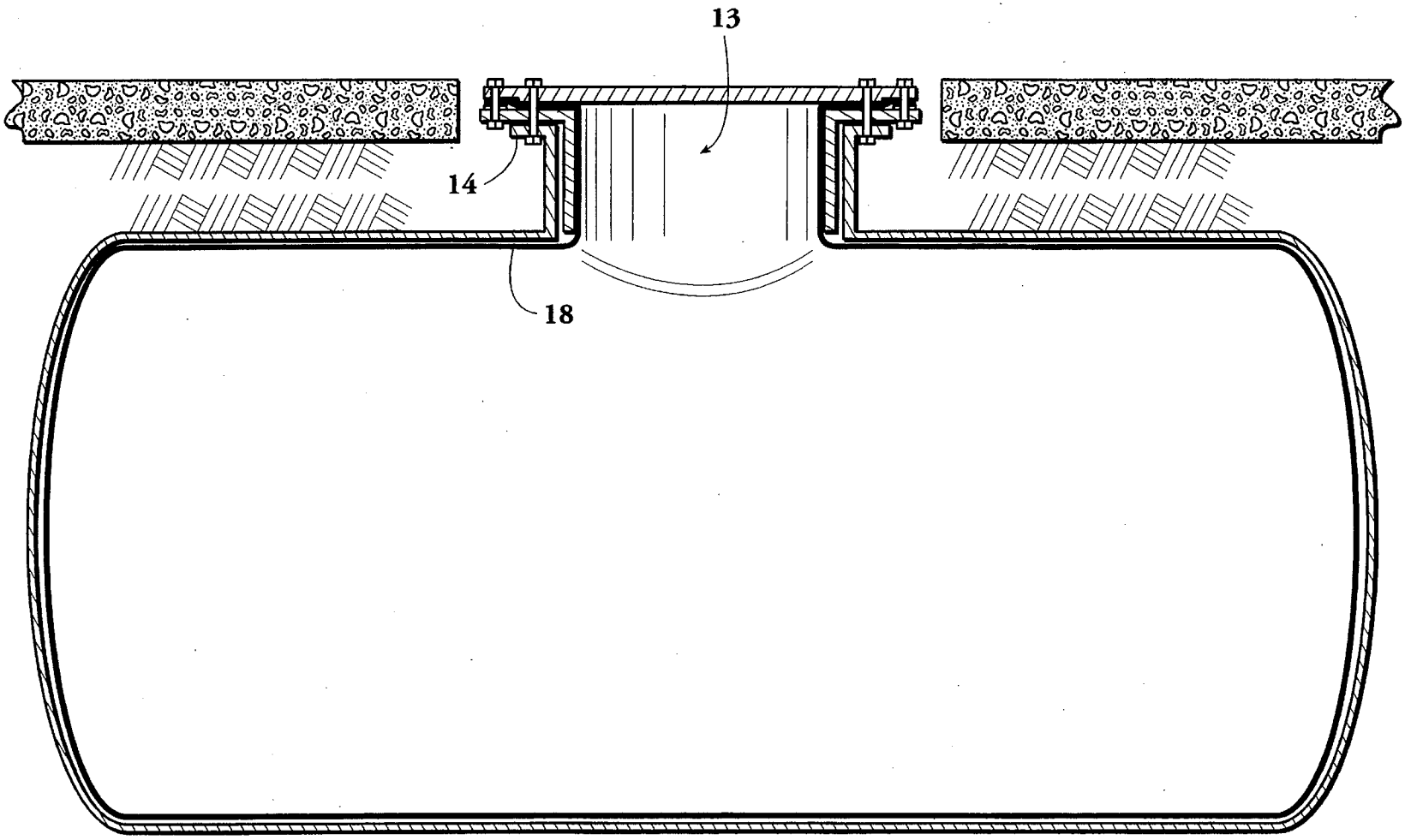
FIG. 2 is a cross-sectional view of the tank along its longitudinal axis, illustrating the flexible liner in the inflated position.

FIG. 2 shows a cross-section of the underground storage tank with the vacuum collar and flexible liner installed.

Figure 3:
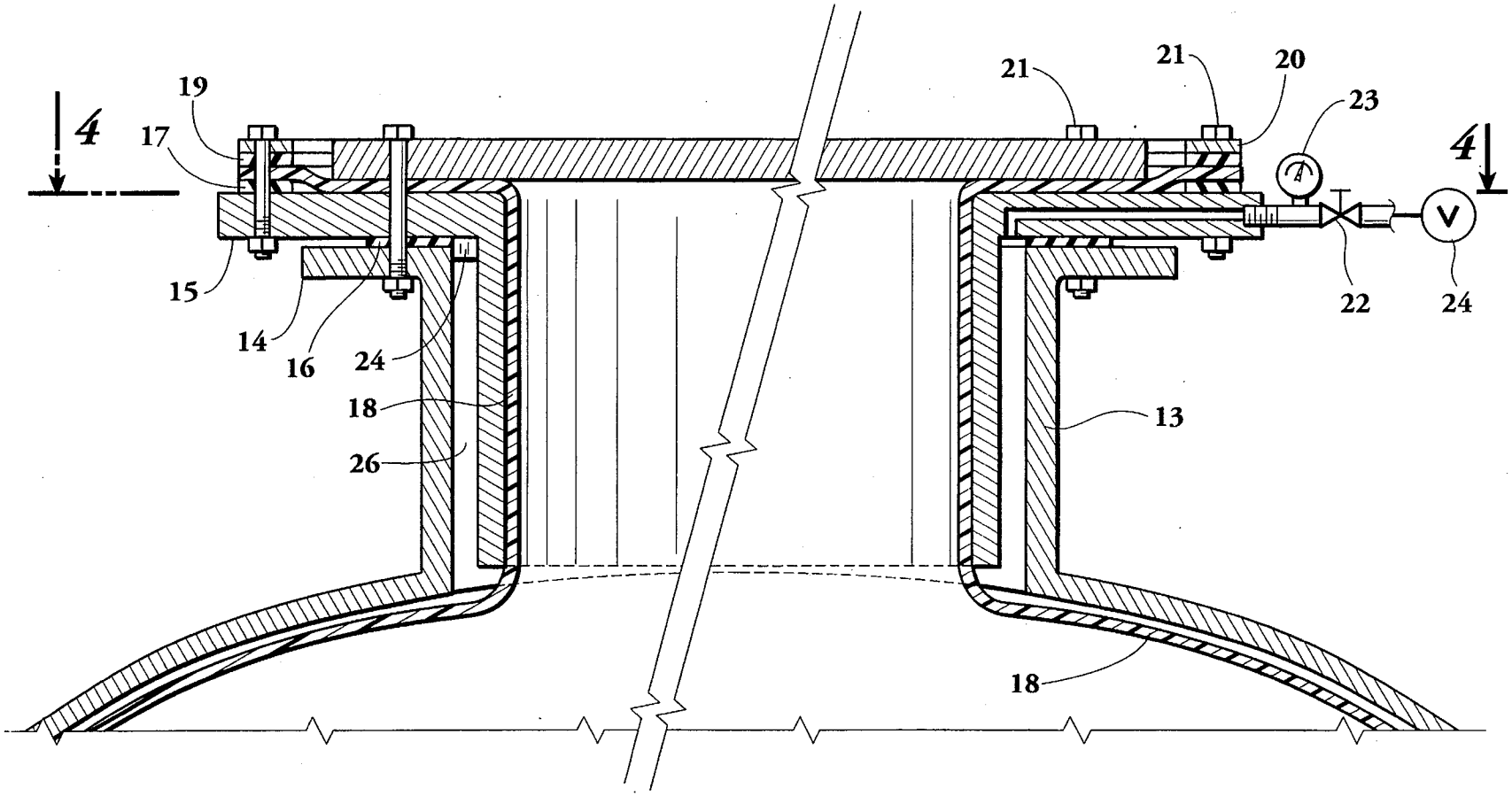
FIG. 3 is a sectional view of one form of manway incorporating the invention.

Referring particularly to FIG. 3 from U.S. Pat. No. 5,397,020, an access opening or manway 13 of the storage tank is equipped with a circumferential flange 14 upon which the vacuum collar 15 rests and to which it is attached. In installation, a first gasket 16 is placed on the manway opening flange. The vacuum collar 15 is then placed inside the manway such that it rests on the first gasket 16. The vacuum collar 15 is attached to the manway opening flange 14 by fastening means such as bolts as shown. A second gasket is placed on the top of the vacuum collar and the flexible liner 18 pulled over the second gasket 17. A third gasket 19 is then placed over the top of the flexible liner. A steel rim 20 is then placed over the third gasket and the assembly secured by fastening means such as bolts 21 as shown in FIG. 3.

Figure 4:
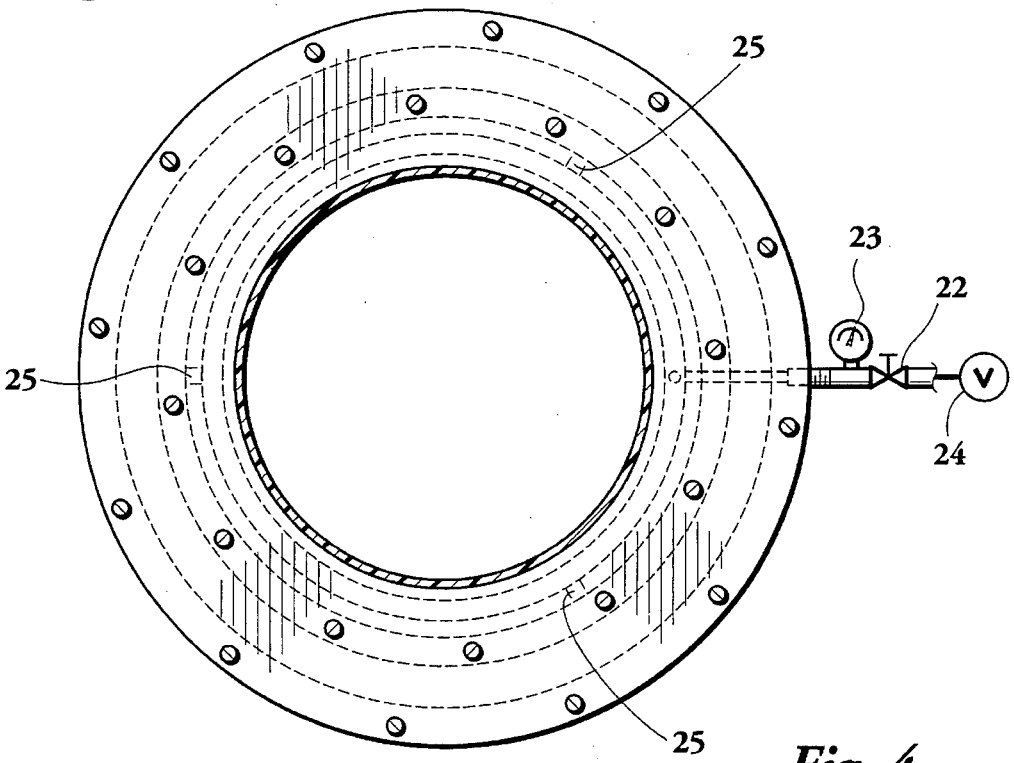
FIG. 4 is a top plan view of the manway shown in FIG. 3.

The vacuum collar, as shown in FIGS. 3 and 4, is constructed such that it has one or a plurality of openings whereby negative pressure or vacuum may be drawn through it and into an exhaust valve 22. The exhaust valve is connected to a gauge 23 which indicates the presence of negative pressure or vacuum and is further connected to a vacuum pump 24. The vacuum collar also contains a plurality of standoffs 25 to allow for an annular space 26 between the inner wall of the manway and the outer wall of the vacuum collar.

Figure 5:
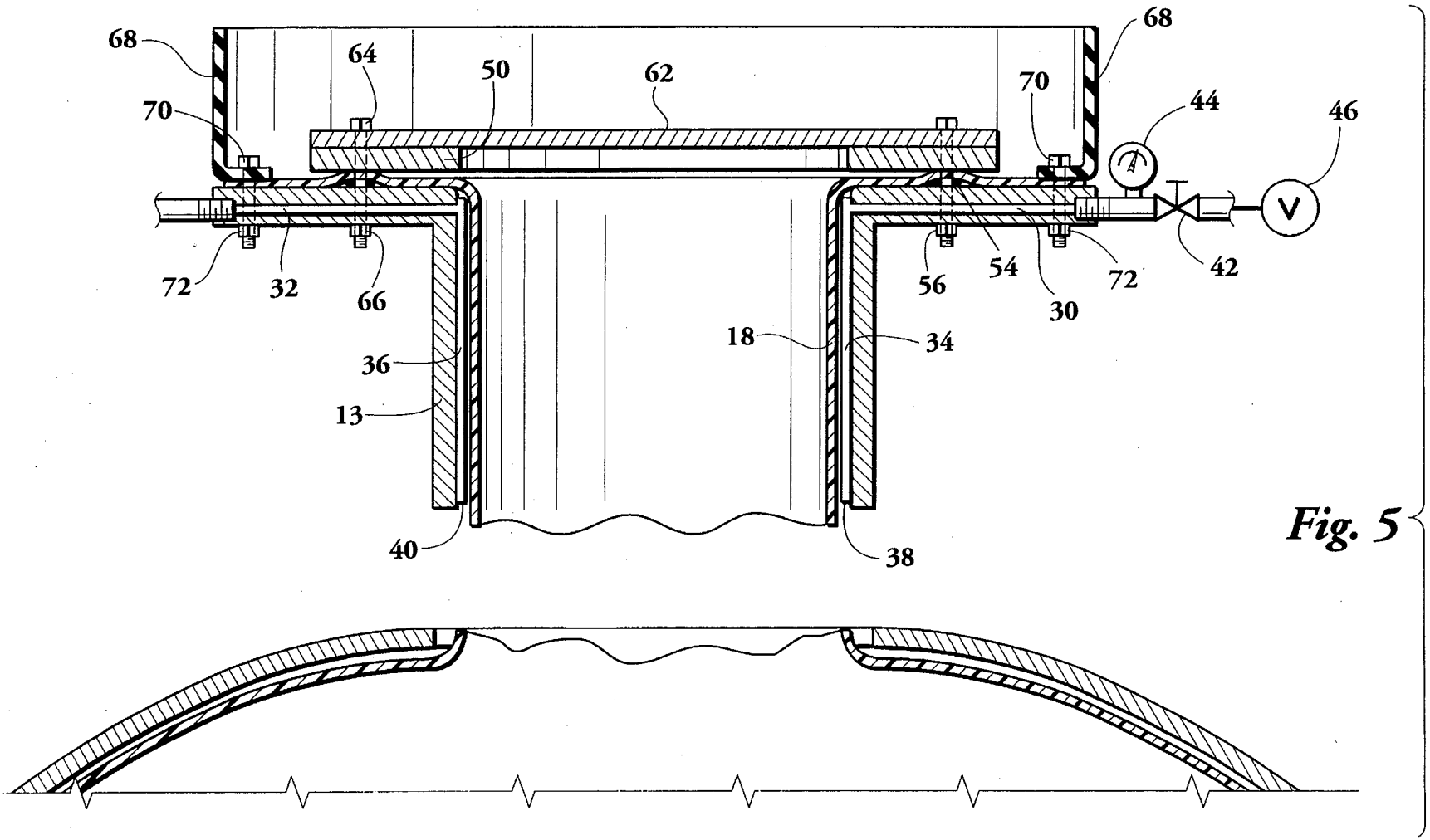
FIG. 5 is a partial sectional view of another embodiment of a manway opening of this invention.
Figure 6:
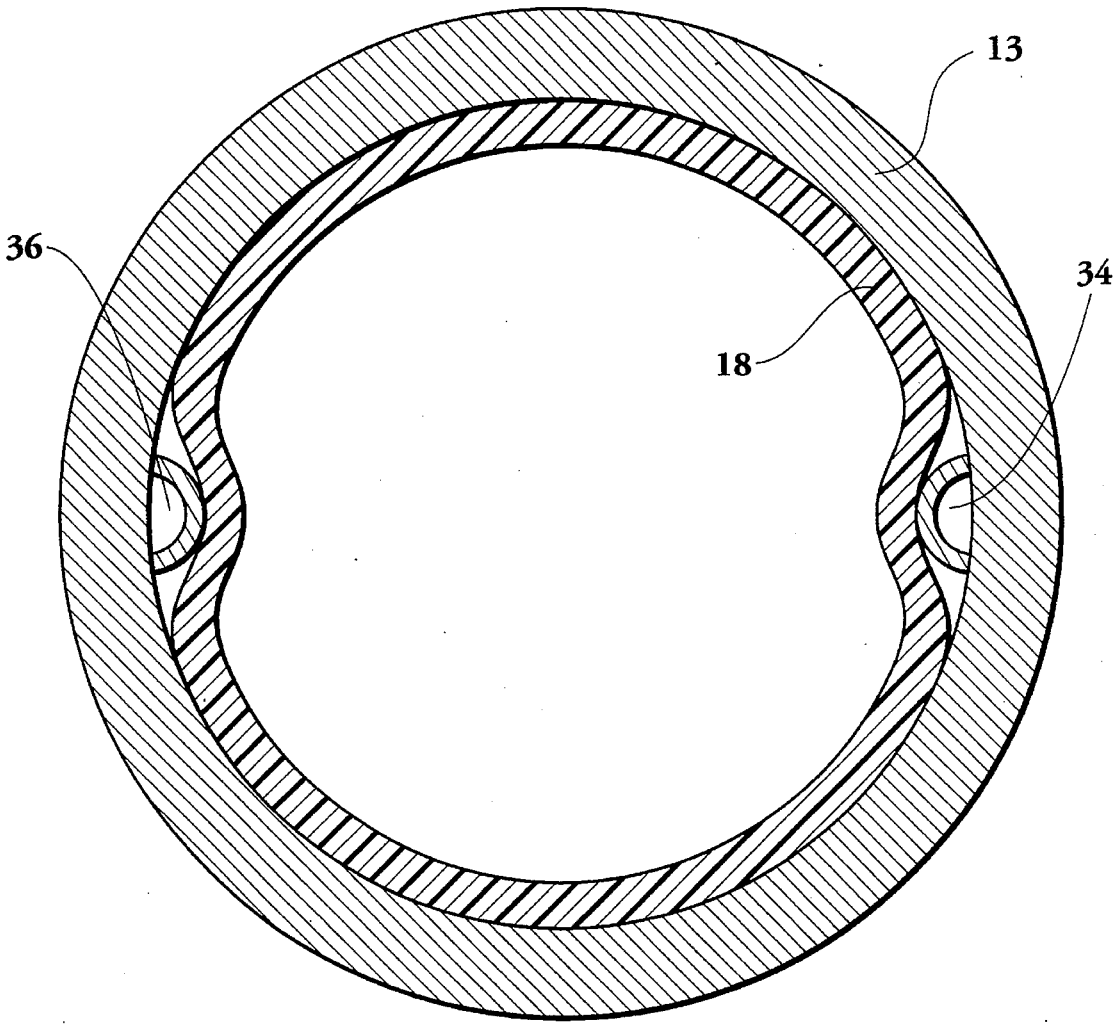
FIG. 6 is a sectional view taken along the line 4—4 of FIG. 3.

Referring to the improvement found in FIGS. 5 and 6, the access opening or manway 13 of the storage tank is equipped with a circumferential flange 14. The flange includes one or a plurality of horizontal conduits 30 and 32 which are in communication with respective vertical pathways 34 and 36 which are open at their bottom ends 38 and 40. These pathways facilitate drawing a vacuum between the liner, and the tank can be welded or formed as a part of the manway 13, or as added tubular members attached thereto the internal periphery of the manway. Vacuum communication with the pathway can also be made through the vertical portion 13 of the manway or via the horizontal conduits 30, 32 such that negative pressure or vacuum may be drawn therethrough as controlled by exhaust valve 42. A gauge 44 indicates the presence of negative pressure or vacuum. The exhaust end of the conduit is connected to a vacuum pump 46.

Figure 9:
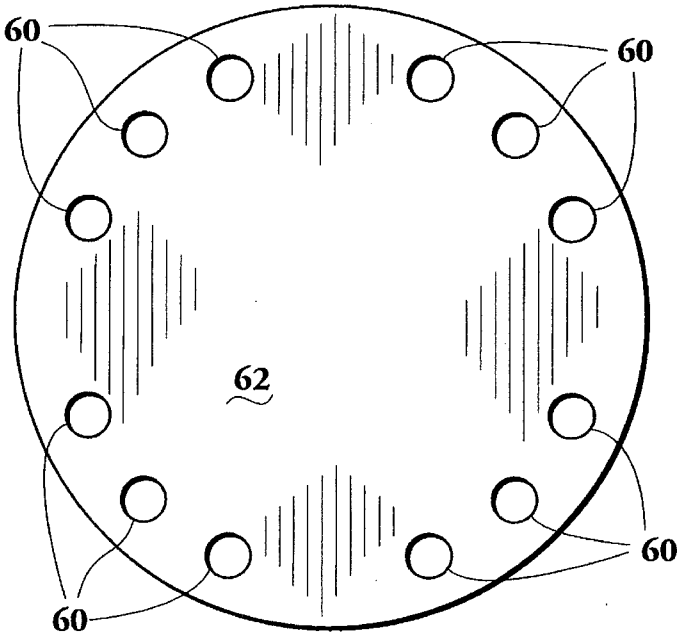
FIG. 9 is a top plan view of the cover plate used in the construction of the manway assembly.
Figure 7:
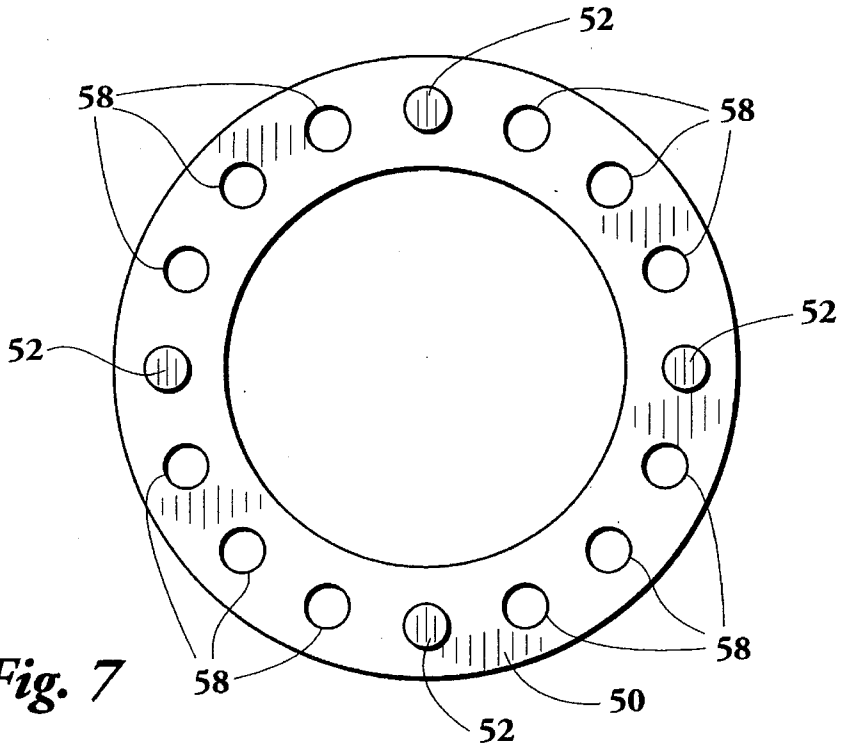
FIG. 7 is a top plan view of a compression ring used in the construction of the manway assembly.
Figure 8:
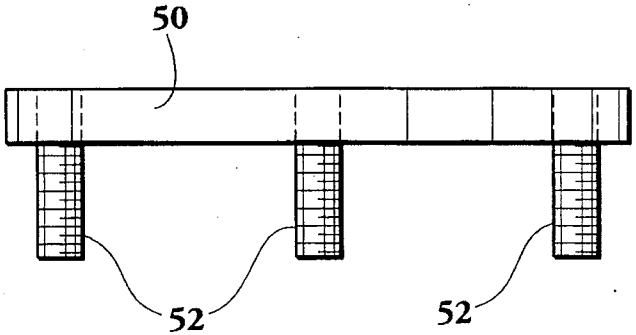
FIG. 8 is a side elevation view of the compression ring shown in FIG. 5.

The manhole assembly includes the flexible liner 18 which extends over the top of the flange 14 and retained thereto, as shown in FIGS. 5 and 6, by a compression ring 50 which provides the primary seal. As shown in FIGS. 7 and 8, a plurality of threaded studs 52 extends through the liner 15, gasket 54 and the flange 14 and held by nuts 56. Thus, removal of cover plate 62 can occur without loss of vacuum. A plurality of circumferential holes 58 are provided to match with holes 60 in a removable cover plate 62, as shown in FIG. 9, in order to receive threaded bolts 64 from the cover plate through the compression ring 50, flexible liner 18 and flange 14 to connect with nuts 66. The assembly may include a cylindrical spill ring or guard 68 that is also bolted through the liner to the flange 14 by bolts 70 and nuts 72, as shown in FIG. 5.

The vacuum collar as described may be installed on any storage tank whether such storage tank is underground or above ground, and is intended to facilitate the establishment and maintenance of a negative pressure or vacuum between the inner wall of the storage tank and the outer wall of the flexible lining.

While the invention has been described with a certain degree of particularity, it is manifest that many changes may be made in the details of construction and the arrangement of components without departing from the spirit and scope of this disclosure. It is understood that the invention is not limited to the embodiment set forth herein for purposes of exemplification, but is to be limited only by the scope of the attached claim or claims, including the full range of equivalency to which each element thereof is entitled.

What is claimed:

1. A storage tank, said tank equipped with a flexible liner inside the tank, wherein an external surface of the flexible liner is maintained in close proximity to an internal surface of said storage tank by a vacuum between the internal surface of said storage tank and the external surface of said flexible liner, said storage tank having a manway, said manway comprised of a vertical portion and an upper horizontal flange said vertical portion including at least one vertical pathway, each pathway open at its bottom and in communication with a conduit in said horizontal flange;

said flexible liner including a portion that extends upward through said vertical portion of said manway and outward along said horizontal flange; and means to maintain a vacuum within said pathway.

2. The storage tank as in claim 1 wherein said means to maintain a vacuum includes a vacuum gauge observable from the outside of said storage tank, to show the presence of vacuum within the said conduit and pathway.

3. The storage tank of claim 1 including means to sealable connect said flexible liner to said horizontal flange and a removable cover to sealably close said manway opening.

4. The storage tank of claim 3 wherein said means to sealably connect said flexible liner to said horizontal flange includes a compression ring having a plurality of vertical threaded studs extending through said flexible liner and bolted to said horizontal flange.

5. The storage tank of claim 4 including a vertical and cylindrical spill guard sealably connected to said horizontal flange and surrounding said cover.

* * * * *